US005459927A

United States Patent [19]

Kauer et al.

[11] Patent Number: 5,459,927

[45] Date of Patent: Oct. 24, 1995

[54] SHAVING APPARATUS WITH ADJUSTABLE FOIL-TYPE UPPER CUTTER

[75] Inventors: Gerald Kauer, Ferlach; Herbert Piber, Klagenfurt, both of Austria

[73] Assignee: U.S. Philips Corporation, New York, N.Y.

[21] Appl. No.: 330,650

[22] Filed: Oct. 28, 1994

[30] Foreign Application Priority Data

Nov. 5, 1993 [AT] Austria ..... 2250/93

[51] Int. Cl.[6] ..... B26B 19/10

[52] U.S. Cl. ..... 30/43.1; 30/346.51

[58] Field of Search ..... 30/43.1, 43.2, 30/43.92, 346.31, 43

[56] References Cited

U.S. PATENT DOCUMENTS

| | | | |
|---|---|---|---|
| 3,271,834 | 9/1966 | Starre | 30/346.51 |
| 3,694,916 | 10/1972 | Harms et al. | 30/43.1 |
| 4,797,997 | 1/1984 | Pacuham et al. | 30/43.1 X |

FOREIGN PATENT DOCUMENTS

| | | | |
|---|---|---|---|
| 2033198 | 2/1971 | Germany | B26B 19/04 |
| 3-965 | 1/1991 | Japan | B26B 19/04 |

*Primary Examiner*—Douglas D. Watts
*Attorney, Agent, or Firm*—Ernestine C. Bartlett

[57] ABSTRACT

A shaving apparatus (1) is provided which includes a housing (5), a shaving-head frame (6), which is detachably mounted on the housing (5), a lower cutter (12), a foil-type upper cutter (11) cooperating with a cutting area (14) of the lower cutter (12) and mounted in a foil-cutter frame (21) which is pivotably mounted in the shaving-head frame (6), which upper cutter has at least two aperture fields (31, 32) which differ as regards the form of the hair-entry apertures (33, 34), and a control member (35) for actuating the foil-cutter frame (21), which control member is coupled to the foil-cutter frame (21) via an actuating device (36), the control member (35) is movably mounted on the housing (5) of the shaving apparatus (1), and the actuating device (36) comprises an actuating frame (38) which engages underneath the foil-cutter frame (21) at a location remote from the foil-type upper cutter (11), which actuating frame is mounted in the shaving apparatus (1) so as to be pivotable about a pivotal axis (43) parallel to the pivotal axis (26) of the foil-cutter frame (21).

7 Claims, 5 Drawing Sheets

SHAVING APPARATUS WITH ADJUSTABLE FOIL-TYPE UPPER CUTTER

FIELD OF THE INVENTION

The invention relates to a shaving apparatus comprising a housing, a shaving-head frame, which is detachably mounted on the housing, a lower cutter, arranged inside the shaving-head frame and having a cutting area which is curved relative to an axis of curvature, which lower cutter is reciprocating drivable at least parallel to the axis of curvature, a foil-cutter frame mounted in the shaving-head frame so as to be pivotable about a pivotal axis parallel to the axis of curvature, on which foil-cutter frame a foil-type upper cutter is mounted, which upper cutter engages with the cutting area of the lower cutter, has hair-entry apertures, and at least two aperture fields which differ as regards the form of the hair-entry apertures, and a hand-actuated control member for actuating the foil-cutter frame, which control member is coupled to the foil-cutter frame via a movable actuating device, the foil-cutter frame being pivotable about its pivotal axis via the actuating device by actuation of said control member to bring each time one of the aperture fields of the shear foil into operative engagement with the cutting area of the lower cutter.

BACKGROUND OF THE INVENTION

A shaving apparatus of the type defined in the opening paragraph is known from, for example, DE 20 33 198 A, which corresponds substantially to U.S. Pat. No. 3,694,916. In this known shaving apparatus the control member is formed by a small rotary knob which is rotatably mounted on the shaving-head frame, and the actuating device is formed by a square pin which projects from the foil-cutter frame and which engages a recess in the rotary knob. Such a construction is comparatively simple but has some drawbacks because the actuation of the control member mounted on the shaving-head frame may lead to unfavourable loads being exerted in the direction of the axis of curvature by the means which secure the shaving-head frame to the housing (1), because the actuating device acts on one side of the foil-cutter frame, resulting in a non-uniform force distribution on the foil-cutter frame, because the control member can only be of a comparatively small and inconvenient design (3), because the shaving apparatus is comparatively inconvenient to hold while the control member is actuated since the actuation of the control member of the shaving apparatus, which is held in one hand, requires a change of the hold of this hand or the other hand, and (4) because it is comparatively difficult to control additional operating functions by means of the control member.

SUMMARY OF THE INVENTION

An object of the invention is to construct a shaving apparatus of the type defined in the opening paragraph, i.e. a shaving apparatus in which a foil-type upper cutter is mounted in a foil-cutter frame, so as to preclude the problems as arising with the apparatus known from DE 20 33 198 A. Another object of the invention is to ensure a reliable pivoting of the foil-cutter frame by means of the actuating device and a uniform distribution of the actuating forces exerted on the foil-cutter frame by the actuating device.

According to the invention, this object is achieved in that the control member is movably mounted on the housing of the shaving apparatus to actuate the foil-type upper cutter, and in that the actuating device comprises an actuating frame which engages underneath the foil-cutter frame at a location remote from the upper cutter, which actuating frame is mounted in the shaving apparatus so as to be pivotable about a pivotal axis parallel to the pivotal axis of the foil-cutter frame. This ensures that the shaving apparatus is simple and easy to handle when the control member is actuated because the actuation of the control member of the shaving apparatus, which is held in one hand, requires neither a change of the hold of this hand nor the other hand. It also ensures that the control member can be of a comparatively large and convenient design, that the control member easily and simply allows additional operating functions, such as turning on and turning off the motor, to be controlled. Additionally, a very simple and reliable coupling of the actuating device to the foil-cutter frame is achieved owing to the engagement of the actuating frame underneath the foil-cutter frame when the shaving-head frame is fitted onto the housing of the shaving apparatus, and a reliable pivoting of the foil-cutter frame by means of the actuating frame is achieved, the actuating frame ensuring in an advantageous manner that the actuating forces exerted on the foil-cutter frame are uniformly distributed. Moreover, the foil-cutter frame and the actuating frame for the foil-cutter frame are disengageable very simply when the shaving-head frame is removed because the foil-cutter frame is then simply moved away from the actuating frame engaging underneath it, without any interlocking couplings between the two frames having to be detached. When the shaving-head frame is removed the instantaneous position of the actuating frame is preserved, so that upon replacement of the shaving-head frame the actuating frame automatically returns the foil-cutter frame into the position selected before the removal of the shaving-head frame.

It is to be noted that it is known per se, for example from JP-U 3-965, to arrange a control member for the actuation of a foil-type upper cutter on the housing of a shaving apparatus and to mount this control member adjustably on this housing. This JP-U 3-965 discloses a shaving apparatus with a housing, with a shaving-head frame which is detachably mounted on the housing, with an adjustable foil-type upper cutter, and with a control member which is adjustably mounted on the housing to adjust the upper cutter, which control member is coupled to the foil-type upper cutter via an actuating device formed by an essentially fork-like actuating slide. However, said shaving apparatus does not have a foil-cutter frame but the foil-type upper cutter is merely connected to a guide strip at each of its two ends which extend transversely of its adjustment directions, one of said guide strips being coupled to each time one of the two ends of the fork-like actuating slide via one pin-hole coupling each. In comparison therewith, a pivotable foil-cutter frame provides a considerably more stable and more reliable mounting for the foil-type upper cutter than a mounting by means of two guide strips. Moreover, coupling the fork-like actuating slide to and releasing it from the relevant guide strip, which is necessary for mounting and removal of the shaving-head frame, requires a separate and inconvenient manipulation, which is disadvantageous in view of simple handling.

In a shaving apparatus in accordance with the invention the actuating frame can be pivotable about a pivotal axis which is offset from the pivotal axis of the foil-cutter frame but this results in a relative movement between the actuating frame and the foil-cutter frame. Therefore, it has proved to be particularly advantageous if the actuating frame is mounted so as to be pivotable about a pivotal axis which coincides with the pivotal axis of the foil-cutter frame. This is very advantageous for a low-friction actuation of the foil-cutter frame by the actuating frame.

It has also proved to be advantageous if, in a plan view of the foil-cutter frame and the actuating frame, the actuating frame is disposed substantially within the foil-cutter frame, and the actuating frame has four projections which extend away from the actuating frame transversely of the pivotal axis of the actuating frame in oppositely directed pairs, with which projections the actuating frame engages underneath two frame members of the foil-cutter frame, which frame members extend parallel to the pivotal axis of the foil-cutter frame. This is advantageous for a construction which is as simple and compact as possible.

Moreover, it has proved to be particularly advantageous if the control member is formed by a sliding button which is pivotally coupled to an actuating lever of the actuating device, which actuating lever is also pivotally coupled to the actuating frame of the actuating device. This is advantageous for a construction which is as simple as possible.

BRIEF DESCRIPTION OF THE DRAWINGS

The invention will now be described in more detail with reference to an embodiment shown in the drawings and given by way of non-limitative example.

DETAILED DESCRIPTION OF THE PREFERRED EMBODIMENTS

Figure 1:
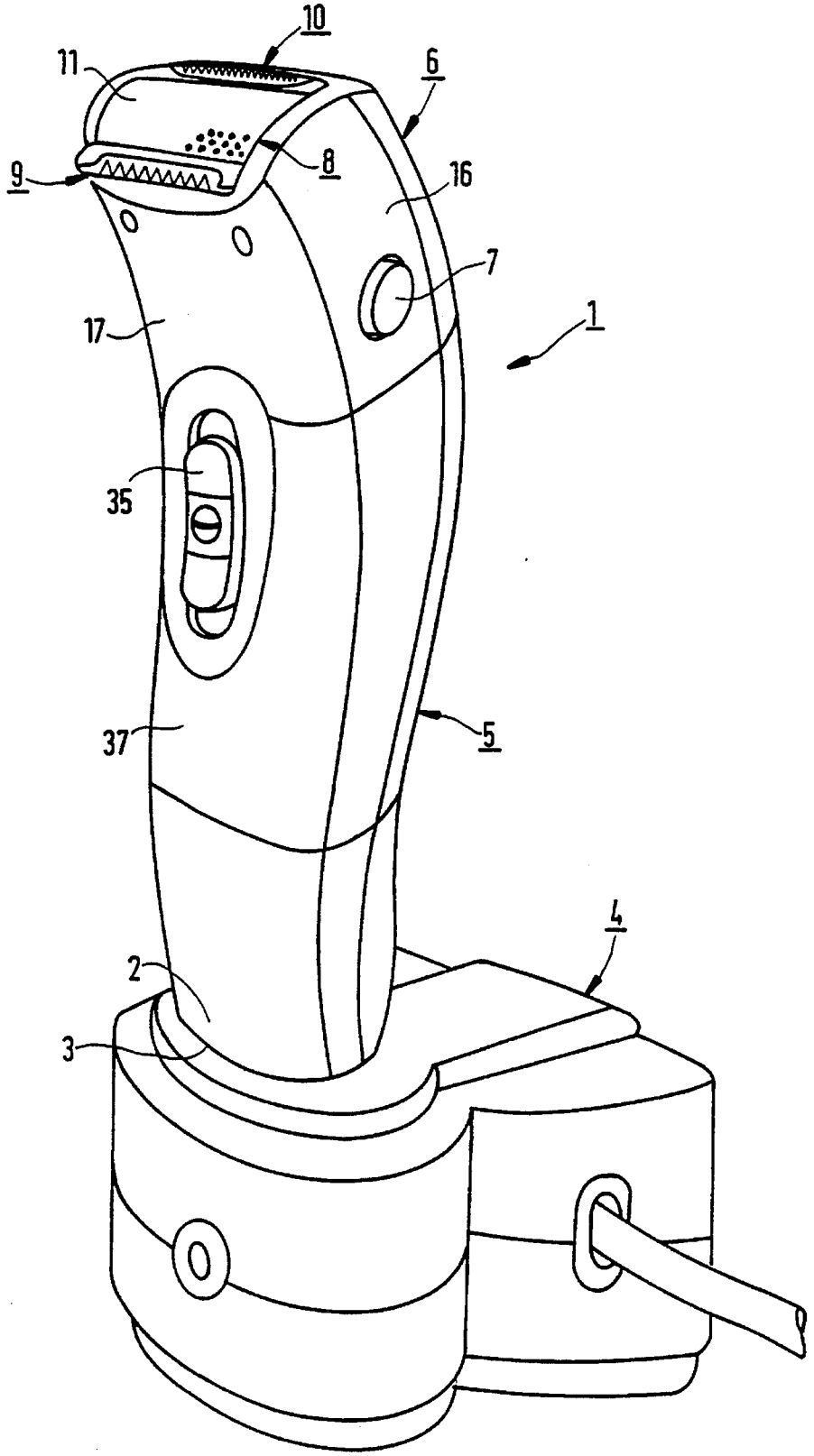
FIG. 1 is an oblique view showing a shaving apparatus plugged into a charging unit, which apparatus comprises a shear foil of a short-hair cutting device, which foil is movable in opposite directions from a rest position into two operating positions, the shaving apparatus having a sliding button, which for adjustment of the shear foil is slidable in two opposite directions from an off-position into two on-positions, and two toothed cutting devices adjacent the shear foil.
Figure 2:
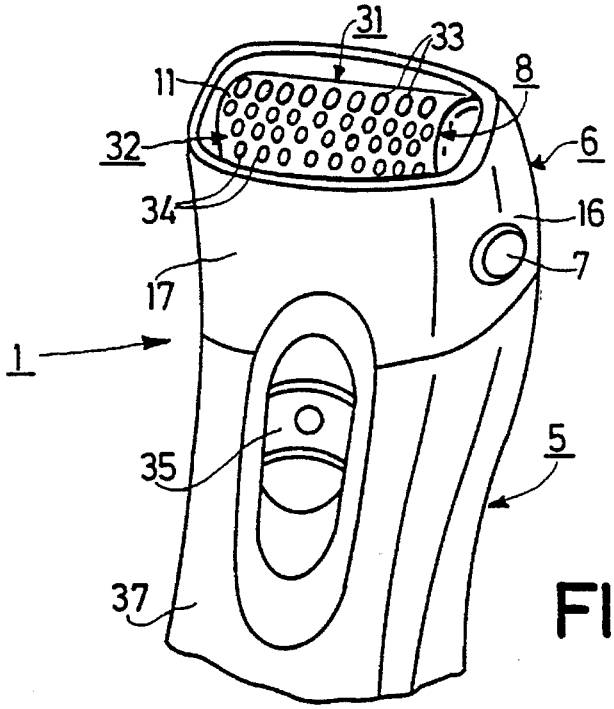
FIG. 2 shows the shaving head area of the shaving apparatus in FIG. 1 without the two toothed cutting devices, the sliding button being in its off-position and the shear foil being in its rest position.
Figure 3:
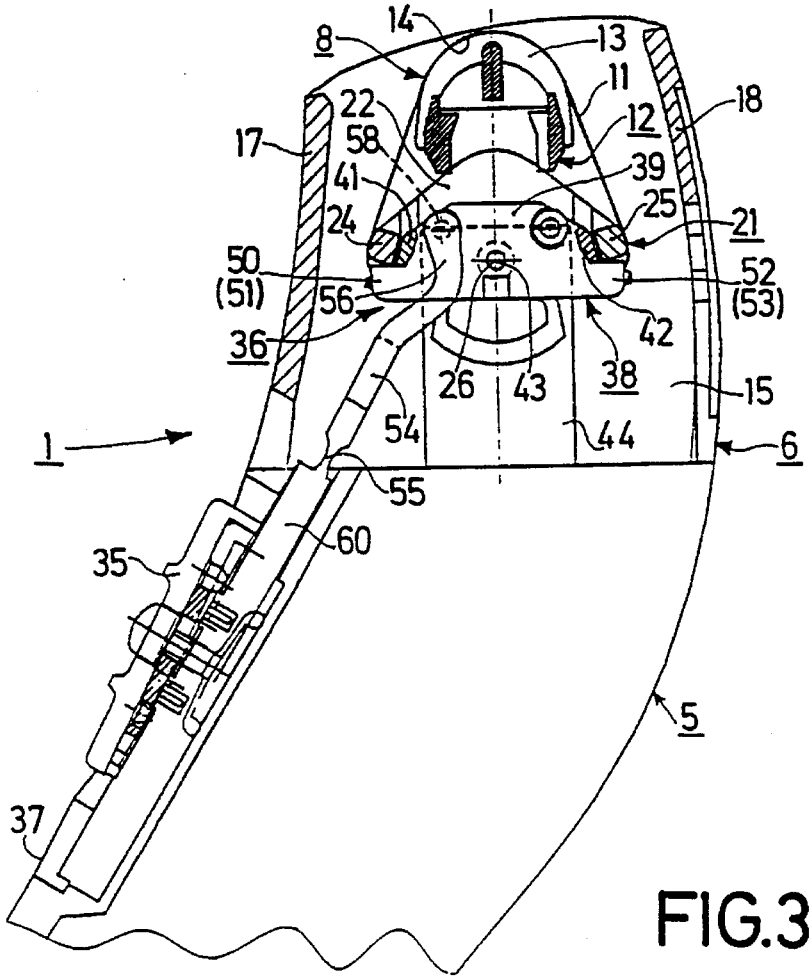
FIG. 3 is a cross-sectional view showing the shaving head area of the shaving apparatus in FIG. 1 without the two toothed cutting devices, the sliding button being in its off-position and the shear foil being in its rest position.
Figure 4:
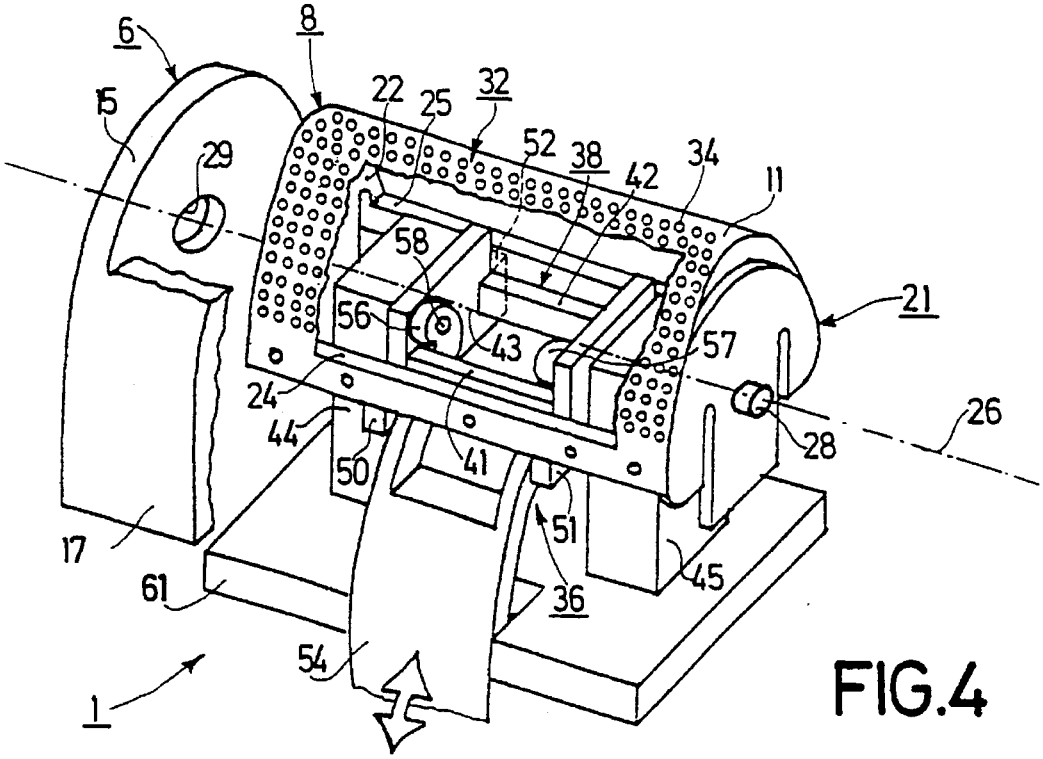
FIG. 4 is a diagrammatic oblique view of the shaving head area of the shaving apparatus in FIG. 1 without the two toothed cutting devices and the drivable lower cutter which cooperates with the shear foil, the shear foil being in its rest position.

FIG. 1 shows a shaving apparatus 1, in the present case a so-called lady shaver. With its lower end 2 the shaving apparatus 1 is plugged into a charging unit 4 to charge the rechargeable batteries accommodated in the shaving apparatus 1.

Figure 5:
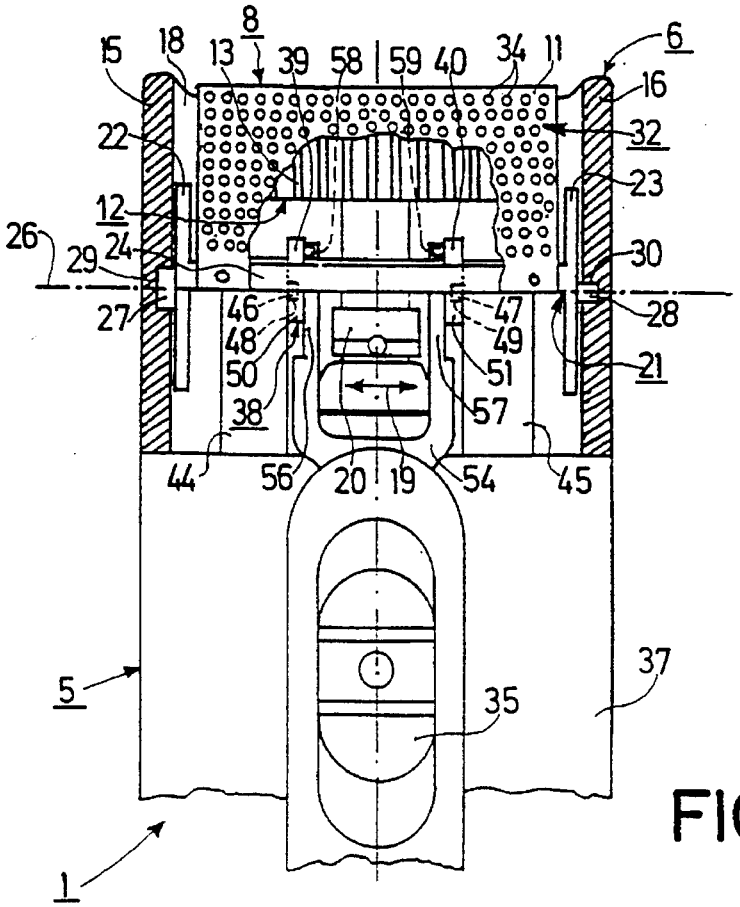
FIG. 5 is a longitudinal sectional view showing the shaving head area of the shaving apparatus in FIG. 1 without the toothed cutting device, the sliding button being in its off-position and the shear foil being in its rest position.

The shaving apparatus 1 has a housing 5 with a gently curved shape. A shaving-head frame 6 is detachably mounted on the housing 5 by means of locking devices, not shown. To release the locking devices two push-buttons 7, of which only one button 7 is visible in FIG. 1, are provided at opposite sides on the shaving-head frame 6. A short-hair cutting device 8 and two long-hair cutting devices 9 and 10 are mounted in the shaving-head frame 6. The short-hair cutting device 8 comprises a foil-type upper cutter 11, hereinafter briefly referred to as the shear foil 11, and a drivable lower cutter 12 constructed as a lamellar cutter comprising a plurality of cutter lamellae or cutter blades 13, as is illustrated in FIG. 5. In known manner the long-hair cutting devices 9 and 10 are constructed as toothed cutting devices. One long-hair cutting device 9 of the long-hair cutting device 9 and 10 is fixedly mounted relative to shaving-head frame 6 and the other long-hair cutting device 10 is mounted so as to be movable relative to the shaving-head frame 6, i.e. between a rest position shown in FIG. 1 and an operating position, not shown, in which this other long-hair cutting device 10 is slid out of the shaving-head frame 6.

As stated, the short-hair cutting device 8 comprises a lower cutter 12 arranged inside the shaving-head frame 6 and having a cutting area 14 which is curved relative to an axis of curvature, not referenced in the Figures, which cutting area is defined by the cutting faces or cutting edges of the lamellae 13 of the lower cutter 12. This axis of curvature extends perpendicularly to two transverse walls 15 and 16 and parallel to two longitudinal walls 17 and 18 of the shaving-head frame 6. The lower cutter 12 is reciprocatingly drivable parallel to the axis of curvature, for which the shaving apparatus 1 comprises a drive member 20, which in a manner not shown is reciprocatingly drivable parallel to the axis of curvature as indicated by the double arrow 19 in FIG. 5 by a drive motor of the shaving apparatus 1.

As stated, the short-hair cutting device 8 comprises a shear foil 11. The shear foil 11 is mounted on a foil-cutter frame 21. The foil-cutter frame 21 has two transverse walls 22 and 23, which extend parallel to the transverse walls 15 and 16 of the shaving-head frame 6 and which are interconnected via two frame members 24 and 25 which extend parallel to the longitudinal walls 17 and 18 of the shaving-head frame 6 and parallel to said axis of curvature. The shear foil 11 is secured to the frame members 24 and 25 by means of ultrasonically welded studs. The foil-cutter frame 21 is mounted in the shaving-head frame 6 so as to be pivotable about a pivotal axis 26 parallel to the axis of curvature. For this purpose the foil-cutter frame 21 has two cylindrical trunnions 27 and 28 which project outwardly from its two transverse walls 22 and 23 and which rotatably engage in bores 29 and 30 in the transverse walls 15 and 16 of the shaving-head frame 6.

In known manner the shear foil 11 has hair-entry apertures. In the present shaving apparatus 1 the shear foil 11 has two aperture fields 31 and 32 which differ as regards the form of the hair-entry apertures, the aperture field 31 having larger hair-entry apertures 33 for severing hairs on the legs and the aperture field 32 having smaller hair-entry apertures 34 for severing hairs in the axillary region.

For the actuation of the foil-cutter frame 21 the shaving apparatus 1 has a hand-actuated control member 35 formed by a sliding button. The sliding button 35 is coupled to the foil-cutter frame 21 via a movable actuating device 36. By actuating the sliding button 35 the foil-cutter frame 21 is pivotable about its pivotal axis 26 via the actuating device 36 to bring one of the two aperture fields 31 or 32 of the shear foil 11 into operative engagement with the cutting area 14 of the lower cutter 12.

In the present shaving apparatus 1 the sliding button 35 for moving the shear foil 11 is movably mounted on the housing 5 of the shaving apparatus 1, i.e. on the wall 37 of the housing 5 of the shaving apparatus 1, adjacent a longitudinal wall 17 of the shaving-head frame 6. The sliding button 35 is movable between an off-position shown in FIGS. 1, 2, 3 and 5, a first on-position shown in FIGS. 6 and 7, and a second on-position shown in FIGS. 8 and 9.

When the sliding button 35 is in its off-position the foil-cutter frame 21 is held in such a position via the actuating device 36 that the shear foil 11 is in a rest position in which the transitional area between the two aperture fields 31 and 32 is situated at the apex of the curved cutting area 14 of the lower cutter 12. When the sliding button 35 is in its off-position this button 35 simultaneously switches off the drive motor of the shaving apparatus 1, in a manner not shown.

Figure 6:
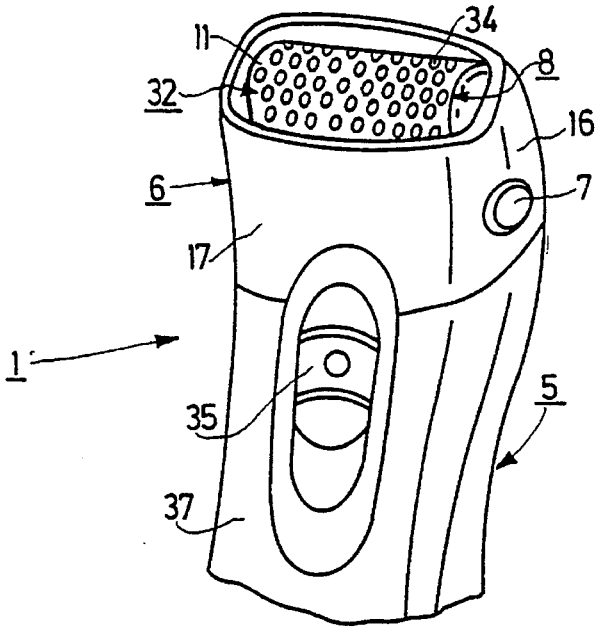
FIG. 6 similarly to FIG. 2 shows the shaving head area of the shaving apparatus in FIG. 1, the sliding button being in its first on-position and the shear foil being in its first operating position.
Figure 7:
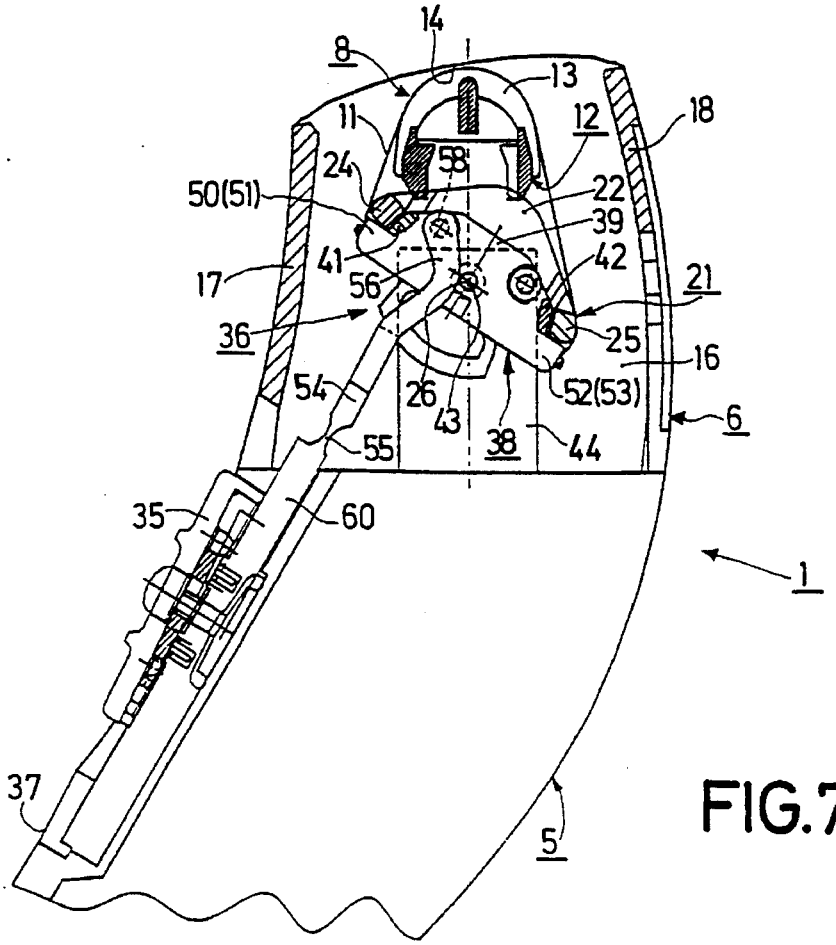
FIG. 7 similarly to FIG. 3 is a cross-sectional view showing the shaving head area of the shaving apparatus in FIG. 1, the sliding button being in its first on-position and the shear foil being in its first operating position.

When the sliding button 35 is in its first on-position the foil-cutter frame 21 is held pivoted into its operating position shown in FIG. 7 via the actuating device 36, the aperture field 32 with the small hair-entry apertures 34 cooperating with the cutting area 14 of the lower cutter 12, as is illustrated in FIG. 6. When the sliding button 35 is in its first on-position the sliding button 35 has also switched on the drive motor of the shaving apparatus 1.

Figure 8:
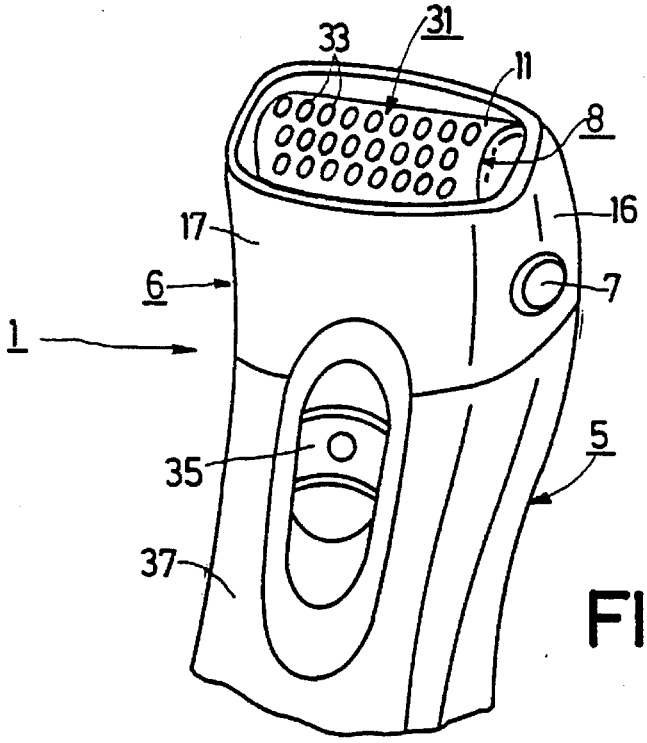
FIG. 8 similarly to FIGS. 2 and 6 shows the shaving head area of the shaving apparatus in FIG. 1, the sliding button being in a second on-position and the shear foil being in a second operating position.
Figure 9:
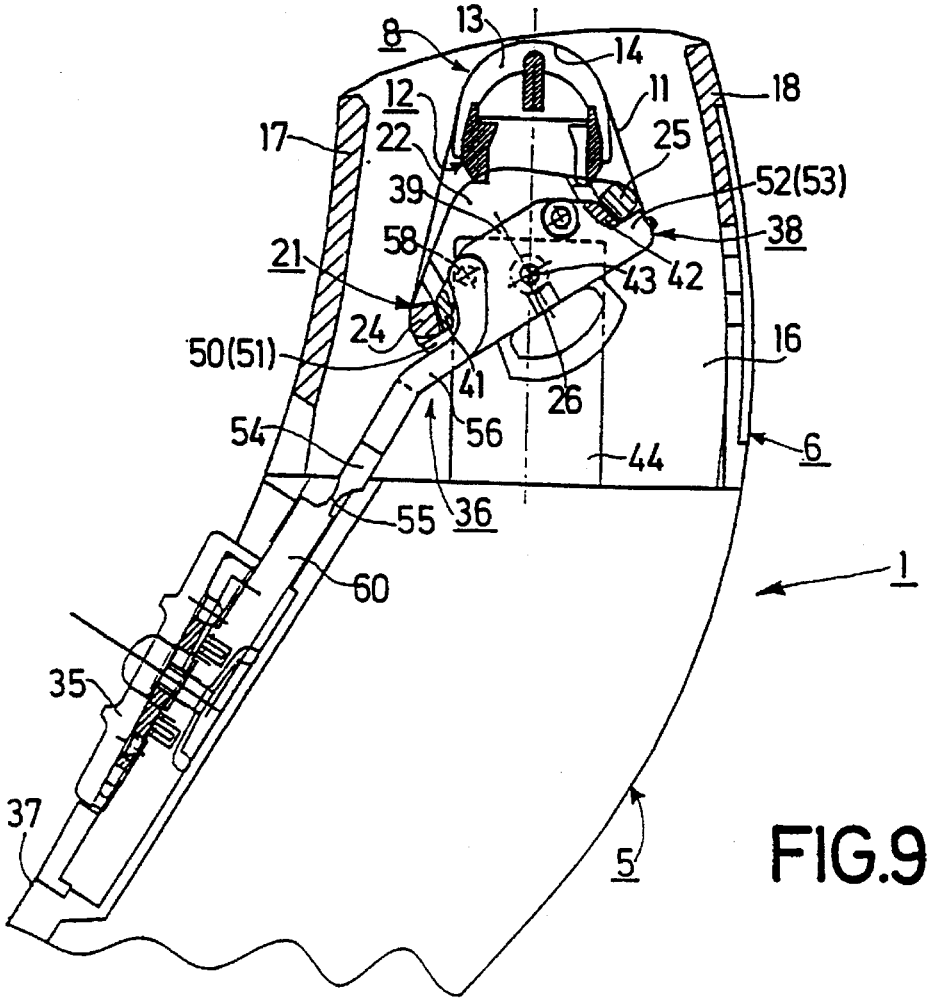
FIG. 9 similarly to FIGS. 3 and 7 is a cross-sectional view showing the shaving head area of the shaving apparatus in FIG. 1, the sliding button being in its second on-position and the shear foil being in its second operating position.

When the sliding button 35 is in its second on-position the foil-cutter frame 21 is held pivoted into its operating position shown in FIG. 9 via the actuating device 36, the aperture field 31 with the large hair-entry apertures 33 cooperating with the cutting area 14 of the lower cutter 12, as is illustrated in FIG. 8. When the sliding button 35 is in its second on-position the sliding button 35 has also switched on the drive motor of the shaving apparatus 1. In the two on-positions of the sliding button 35 the drive motor of the shaving apparatus 1 can reciprocatingly drive the lower cutter 12 with different speeds.

For moving the foil-cutter frame 21 in the shaving apparatus 1 the actuating device 36 advantageously comprises an actuating frame 38 which engages underneath the foil-cutter frame 21 at a location remote from the shear foil 11, as will be described in detail hereinafter. The actuating frame 38, in the same way as the foil-cutter frame 21, comprises two transverse wails 39 and 40, which extend parallel to the transverse walls 15 and 16 of the shaving-head frame 5 and to the transverse walls 22 and 23 of the foil-cutter frame 21. The transverse walls 39 and 40 are interconnected by two frame members 41 and 42, which extend parallel to the longitudinal walls 17 and 18 of the shaving-head frame 6 and to the frame members 24 and 25 of the foil-cutter frame 21. The actuating frame 38 is mounted in the shaving apparatus 1 so as to be pivotable about a pivotal axis 43 parallel to the pivotal axis 26 of the foil-cutter frame 21. In the present shaving apparatus 1 the construction is such that the actuating frame 38 is pivotable about a pivotal axis 43 which coincides with the pivotal axis 26 of the foil-cutter frame 21, as a result of which there will be hardly any relative movement between the two frames 21 and 38 when these frames are pivoted. For the pivotal mounting of the actuating frame 38 the shaving apparatus 1 comprises two bearing blocks 44 and 45 projecting perpendicularly from a mounting plate 61. Two cylindrical trunnions 46 and 47 project towards one another from the end portions of the bearing blocks 44 and 45 and engage in bores 48 and 49 in the transverse walls 39 and 40 of the actuating frame 38.

In a plan view of the foil-cutter frame 21 and the actuating frame 38 the actuating frame 38 is situated substantially within the foil-cutter frame 21. On its transverse walls 39 and 40 the actuating frame 38 has four projections 50, 51, 52 and 53 which extend away from the frame transversely of the pivotal axis 43 of the actuating frame 38 in oppositely directed pairs. With these projections 50, 51, 52 and 53 the actuating frame 38 engages underneath the two frame members 24 and 25 of the foil-cutter frame 21, which extend parallel to the pivotal axis 26 of this foil-cutter frame 21.

The sliding button 35 for moving the foil-cutter frame 21 is pivotally connected to an actuating lever 54 of the actuating device 36 via a hinge 55. The actuating lever 54 is also pivotally connected to the actuating frame 38 of the actuating device 36. For this purpose the actuating lever 54 is fork-shaped at its end adjacent the actuating frame 38, a bore being provided at the location of each of the two end portions 56 and 57 of the actuating lever 54, which bores are engaged by coupling pins 58 and 59 which project from the respective transverse walls 39 and 40 of the actuating frame 38 to form pivots. The sliding button 35 is connected to a slider 60, which is slidably guided in the housing 5 and which is integrally connected to the actuating lever 54 via the hinge 55, which is constructed as an integral hinge.

The use of the control member, i.e. the sliding button, for moving the shear foil on the housing of the shaving apparatus guarantees a simple and convenient operation of the shaving apparatus when the sliding button is actuated and enables the sliding button to be comparatively large and easy-to-handle and enables additional operating functions, such as starting and stopping of the motor of the shaving apparatus, to be controlled easily and simply. Moreover, the construction of the actuating device for the foil-cutter frame as an actuating frame ensures that in the shaving apparatus described above the actuating device is coupled very simply and reliably to the foil-cutter frame in that the foil-cutter frame engages underneath the actuating frame when the shaving-head frame is placed onto the housing of the shaving apparatus and the foil-cutter frame with the actuating frame is pivoted in a particularly satisfactory and reliable manner, the actuating frame ensuring in an advantageous manner that the actuating forces exerted on the foil-cutter frame are uniformly distributed. Moreover, in the shaving apparatus described above the foil-cutter frame and the actuating frame for the foil-cutter frame are disengageable very simply when the shaving-head frame is removed because the foil-cutter frame is then simply moved away from the actuating frame engaging underneath it, without any interlocking couplings between the two frames having to be detached. When in the present shaving apparatus the shaving-head frame is removed the instantaneous position of the actuating frame is preserved, so that upon replacement of the shaving-head frame onto the housing of the apparatus the actuating frame automatically returns the foil-cutter frame into the position selected before the removal of the shaving-head frame.

The invention is not limited to the exemplary embodiment described hereinbefore. A shear foil may, for example, also have three aperture fields which differ in respect of the hair-entry apertures, in which case a foil-cutter frame carrying such a shear foil is set to three different operating positions by means of an actuating frame. Moreover, the actuating frame may be of another construction than in the example described above. In addition, there are other possibilities for the construction of the coupling between the control member for the foil-cutter frame and the actuating frame.

We claim:

1. A shaving apparatus comprising a housing, a shaving-head frame, which is detachably mounted on the housing, a lower cutter, arranged inside the shaving-head frame and having a cutting area which is curved relative to an axis of curvature, which lower cutter is reciprocating drivable at least parallel to the axis of curvature, a foil-cutter frame mounted in the shaving-head frame so as to be pivotable about a pivotal axis parallel to the axis of curvature, on which foil-cutter frame a foil-type upper cutter is mounted, which upper cutter engages with the cutting area of the lower cutter, has hair-entry apertures, and at least two aperture fields which differ as regards the form of the hair-entry apertures, and a hand-actuated control member for actuating the foil-cutter frame, which control member is coupled to the foil-cutter frame via a movable actuating device, the foil-cutter frame being pivotable about its pivotal axis via the actuating device by actuation of said control member to bring each time one of the aperture fields of the shear foil into operative engagement with the cutting area of the lower cutter, characterised in that the control member is movably mounted on the housing of the shaving apparatus to actuate the foil-type upper cutter, and wherein the actuating device comprises an actuating frame which engages underneath the foil-cutter frame at a location remote from the upper cutter, which actuating frame is mounted in the shaving apparatus so as to be pivotable about a pivotal axis parallel to the pivotal axis of the foil-cutter frame.

2. A shaving apparatus as claimed in claim 1, wherein the actuating frame is mounted so as to be pivotable about a pivotal axis which coincides with the pivotal axis of the foil-cutter frame.

3. A shaving apparatus as claimed in claim 1 or 2, wherein in a plan view of the foil-cutter frame and the actuating frame, the actuating frame is disposed substantially within the foil-cutter frame, and the actuating frame has four projections which extend away from the actuating frame transversely of the pivotal axis of the actuating frame in oppositely directed pairs, with which projections the actuating frame engages underneath two frame members of the foil-cutter frame, which frame members extend parallel to the pivotal axis of the foil-cutter frame.

4. A shaving apparatus as claimed in claim 1 wherein the control member is formed by a sliding button which is pivotally coupled to an actuating lever of the actuating device, which actuating lever is also pivotally coupled to the actuating frame of the actuating device.

5. A shaving apparatus as claimed in claim 3 wherein in a plan view of the foil-cutter frame and the actuating frame, the actuating frame is disposed substantially within the foil-cutter frame, and the actuating frame has four projections which extend away from the actuating frame transversely of the pivotal axis of the actuating frame in oppositely directed pairs, with which projections the actuating frame engages underneath two frame members of the foil-cutter frame, which frame members extend parallel to the pivotal axis of the foil-cutter frame.

6. A shaving apparatus as claimed in claim 2 wherein the control member is formed by a sliding button which is pivotally coupled to an actuating lever of the actuating device, which actuating device, which actuating lever is also pivotally coupled to the actuating frame of the actuating device.

7. A shaving apparatus as claimed in claim 3 wherein the control member is formed by a sliding button which is pivotally coupled to an actuating lever of the actuating device, which actuating device, which actuating lever is also pivotally coupled to the actuating frame of the actuating device.

* * * * *